US008125132B2

(12) United States Patent
Hayama et al.

(10) Patent No.: US 8,125,132 B2
(45) Date of Patent: Feb. 28, 2012

(54) DISPLAY APPARATUS

(75) Inventors: Akira Hayama, Sagamihara (JP); Koichi Tsunoda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 36 days.

(21) Appl. No.: 12/858,932

(22) Filed: Aug. 18, 2010

(65) Prior Publication Data

US 2011/0050079 A1 Mar. 3, 2011

(30) Foreign Application Priority Data

Aug. 26, 2009 (JP) ..... 2009-195421
Jul. 14, 2010 (JP) ..... 2010-159637

(51) Int. Cl.
*H01J 1/62* (2006.01)
*H01J 63/04* (2006.01)
*H01J 9/02* (2006.01)

(52) U.S. Cl. ..... 313/310; 313/483; 313/495; 313/496

(58) Field of Classification Search ..... None
See application file for complete search history.

(56) References Cited

U.S. PATENT DOCUMENTS

| | | | | |
|---|---|---|---|---|
| 6,802,753 | B1 | 10/2004 | Ando et al. | 445/6 |
| 7,063,585 | B2 | 6/2006 | Hayama | 445/24 |
| 7,138,758 | B2 | 11/2006 | Ando et al. | 313/495 |
| 7,247,981 | B2 | 7/2007 | Yamazaki | |
| 7,249,989 | B2 | 7/2007 | Hayama | 445/25 |
| 7,449,828 | B2 | 11/2008 | Ando et al. | 313/495 |
| 2002/0084997 | A1 | 7/2002 | Ohnishi | |
| 2006/0103293 | A1 | 5/2006 | Yamazaki | |
| 2009/0072695 | A1 | 3/2009 | Hiroike et al. | 313/292 |
| 2009/0280712 | A1 | 11/2009 | Hayama et al. | 445/22 |
| 2010/0079506 | A1 | 4/2010 | Hayama | 345/690 |

FOREIGN PATENT DOCUMENTS

| | | |
|---|---|---|
| JP | 2002-367540 | 12/2002 |
| JP | 2006-120534 A | 5/2006 |
| JP | 2006-173093 A | 6/2006 |
| JP | 2006-236733 A | 9/2006 |

OTHER PUBLICATIONS

European Search Report (5 pages).

*Primary Examiner* — Natalie Walford
(74) *Attorney, Agent, or Firm* — Fitzpatrick, Cella, Harper & Scinto

(57) ABSTRACT

A display apparatus comprises: a rear plate which has an electron-emitting device; a face plate which has an anode electrode and a potential defining electrode; and a plate spacer which is opposite to the anode electrode and the potential defining electrode, between the rear plate and the face plate. An insulative base member of the spacer has a recessed portion which opposes to the anode electrode, the potential defining electrode, and a portion of the face plate between the anode electrode and the potential defining electrode. Thus, electric discharges between the spacer and the anode electrode and between the spacer and the potential defining electrode can be suppressed.

11 Claims, 4 Drawing Sheets

DISPLAY APPARATUS

BACKGROUND OF THE INVENTION

1. Field of the Invention

The present invention relates to a display apparatus, and, more particularly, to a constitution of a spacer provided between a rear plate and a face plate within the display apparatus.

2. Description of the Related Art

As a display apparatus capable of being thinned and lightened, a flat panel electron beam apparatus, i.e., a field-emission display apparatus (FED), using an electron-emitting device has been proposed. In the display apparatus like this, a rear plate which has the electron-emitting device and a face plate which has a light-emitting member for emitting light in response to irradiation of electrons are arranged to be opposite to each other. The peripheral edges of the rear plate and the face plate are respectively sealed through a frame member to form a vacuum container, and the inside of the vacuum container is maintained with vacuum (typically high vacuum or ultra-high vacuum). The face plate includes an anode electrode which is laminated to the light-emitting member and to which potential higher than that of the rear plate is applied. Electrons emitted by the electron-emitting device are attracted by the anode electrode and thus irradiated to predetermined positions on the light-emitting member, whereby a desired image is displayed.

Generally, high potential of several hundreds of volts to several tens of kilovolts is applied to the anode electrode in order to not only irradiate the electrons to the predetermined positions on the light-emitting member but also improve luminance of the display apparatus. Moreover, a gap between the rear plate and the face plate is made small as much as possible so as to reduce the thickness of the display apparatus. For these reasons, a substantially high electric field is ordinarily generated within the display apparatus, whereby there is a problem of causing an electric discharge especially between the anode electrode and another internal structure. To cope with this problem, it has been known a constitution in which the periphery of the anode electrode is surrounded by a potential defining electrode having the potential often defined to the ground potential.

Incidentally, plate support members called spacers are provided within the display apparatus, to prevent deformation and destruction of the rear plate and the face plate due to a difference between an internal pressure and an external pressure of the display apparatus. More specifically, since the spacers support the rear plate and the face plate by means of pressing force based on the difference between the internal pressure and the external pressure of the display apparatus, each of the spacers is provided to be in contact with the anode electrode. For this reason, the potential of the spacer on the side of the anode electrode is high, whereby there is a problem of causing an electric discharge between the face of the spacer on the side of the anode electrode and the potential defining electrode. Here, Japanese Patent Application Laid-Open No. 2006-173093 discloses a technique of separating a spacer and a potential defining electrode (i.e., a guard electrode) from each other by a necessary distance to prevent an electric discharge generated between the spacer and the potential defining electrode. Further, Japanese Patent Application Laid-Open No. 2006-236733 discloses that an interval between internal ends of low resistance films on a spacer connected to guard electrodes mutually opposite to each other as interposing an anode electrode between them is made larger than an interval between internal ends of the anode electrode and the guard electrode.

SUMMARY OF THE INVENTION

In case of preventing the electric discharge by separating the spacer and the potential defining electrode from each other by the necessary distance as disclosed in Japanese Patent Application Laid-Open No. 2006-173093, it is necessary to form the potential defining electrode extremely thinly so as to secure the distance. This becomes a restriction in manufacturing the display apparatus. Here, when an anode potential further increases, there is a possibility that the above-described constitution cannot cope with such a situation. Incidentally, in order to prevent the electric discharge, it is effective to set the mutual physical objects respectively generating the electric discharges to have the same potential by bringing these objects into contact with each other. With respect to the anode electrode which is in contact with the spacer, the electric discharge is sure not to be generated easily. However, it is difficult to completely bring the spacer and the anode electrode into tightly contact with each other. That is, in fact, there is a possibility that the electric discharge is generated due to a micro-gap which inevitably exists between the spacer and the anode electrode.

Consequently, the present invention aims to suppress, in the display apparatus in which the face plate has the anode electrode and the potential defining electrode positioned apart from the anode electrode, the electric discharge generated between the spacer and the anode electrode and the electric discharge generated between the spacer and the potential defining electrode.

To achieve such an object, a display apparatus according to the present invention comprises: a rear plate which has an electron-emitting device; a face plate which is opposite to the rear plate, and has an anode electrode defined with a potential higher than a potential of the electron-emitting device, and a potential defining electrode positioned apart from the anode electrode and defined with a potential lower than the potential of the anode electrode; and a plate spacer comprising at least an insulative base member and being arranged between the rear plate and the face plate and having a face opposing to the face plate, the face partly contacting with the anode electrode and the potential defining electrode, wherein the insulative base member has a recessed portion in the face, and the recessed portion opposes through a gap to a portion of the face plate between the anode electrode and the potential defining electrode, an end of the anode electrode on a side of the potential defining electrode is positioned closer to the potential defining electrode than an edge of the recessed portion on a side of the anode electrode, and an end of the potential defining electrode on a side of the anode electrode is positioned closer to the anode electrode than an edge of the recessed portion on a side of the potential defining electrode.

According to the present invention, in the display apparatus in which the face plate has the anode electrode and the potential defining electrode positioned apart from the anode electrode, it is possible to suppress the electric discharge generated between the spacer and the face plate.

Further features of the present invention will become apparent from the following description of exemplary embodiments with reference to the attached drawings.

DESCRIPTION OF THE EMBODIMENTS

Initially, a display apparatus of the present invention includes a display apparatus which is equipped with an electron-emitting device 9 of a surface conduction type, a Spindt type, a CNT (carbon nanotube) type, an MIM (metal-insulator-metal) type or a BSD (Ballistic electron Surface-emitting Device) type, and the like. In the display apparatus like this, support members (i.e., spacers) are arranged between a rear plate on which the electron-emitting device is provided and a face plate on which a light emitter (e.g., a phosphor) is provided, as a preferable configuration to which the present invention is applied. Hereinafter, the display apparatus according to an exemplary embodiment of the present invention will be described with reference to the attached drawings.

Figure 1:
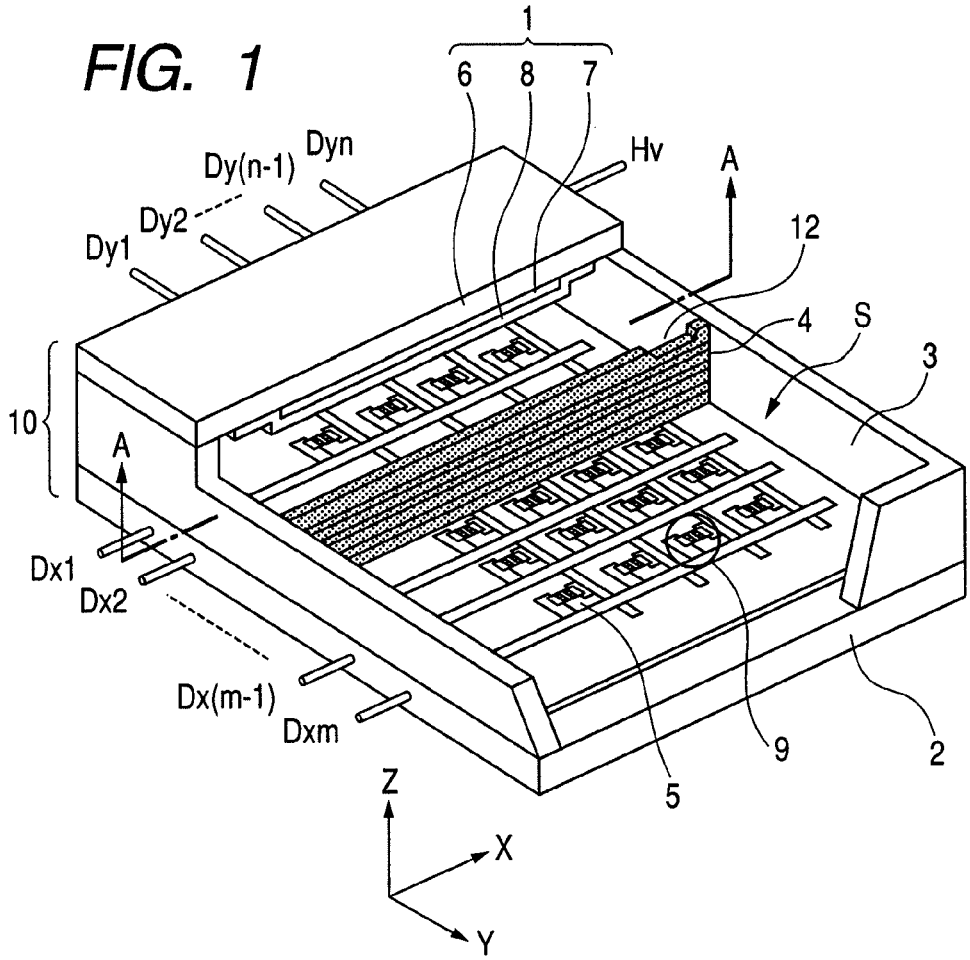
FIG. 1 is a perspective view illustrating an example of a display apparatus according to the present invention.

FIG. 1 is a partial perspective view illustrating an example of the constitution of the display apparatus (hereinafter, called a display apparatus 10). The display apparatus 10 includes a rear plate 2 on which an electron source 5 is provided and a face plate 1 which is positioned opposite to the rear plate 2. Further, the electron source 5 is constituted by numerous electron-emitting devices 9. In the present embodiment, a surface-conduction electron-emitting device is exemplarily used as the electron-emitting device 9. The electron source 5 includes the plural electron-emitting devices 9 arranged like a matrix. More specifically, the electron source 5 includes the electron-emitting devices 9 arranged in a simple matrix by means of X-direction wirings Dx1, Dx2, . . . , Dx(m−1) and Dxm, and Y-direction wirings Dy1, Dy2, . . . , Dy(n−1) and Dyn.

The face plate 1 includes a glass substrate 6, a fluorescent film 7 which is formed inside the glass substrate 6 and functions as a light emitting member, and an anode electrode 8 which is formed so as to be superimposed on the fluorescent film 7 and thus cover the fluorescent film 7. Here, potential (anode potential) higher than the potential of the rear plate 2 (i.e., the potential applied to the electron-emitting devices 9 and the wirings) is supplied from a high-voltage terminal Hv to the anode electrode 8. Typically, the anode potential is 1 kV or more. Electron beams emitted from the electron-emitting devices 9 formed on the rear plate 2 are accelerated toward the face plate 1 by the anode potential supplied to the face plate 1, and thus irradiated to the face plate 1. Then, electrons irradiated to the face plate 1 collide with the fluorescent film 7 formed on the face plate 1. Thus, the phosphor constituting the fluorescent film 7 emits light (i.e., cathodoluminescence). That is, if the electron-emitting devices 9 for emitting light are properly selected by matrix driving, a desired image is reflected (or produced) on the face plate 1. Incidentally, if a metal film is used as the anode electrode 8, the anode electrode 8 functions as a metal back for improving a coefficient of utilization of light by reflecting a part of the light emitted by the fluorescent film 7. The anode electrode 8 may be a transparent electrode. Further, the anode electrode 8 can be formed not only by a single member but also by a proper combination of plural members such as an electro-conductive film, a resistive film and the like. That is, it should be noted that the anode electrode 8 is a general term for the members which are substantially defined to the anode potential.

Figure 2:
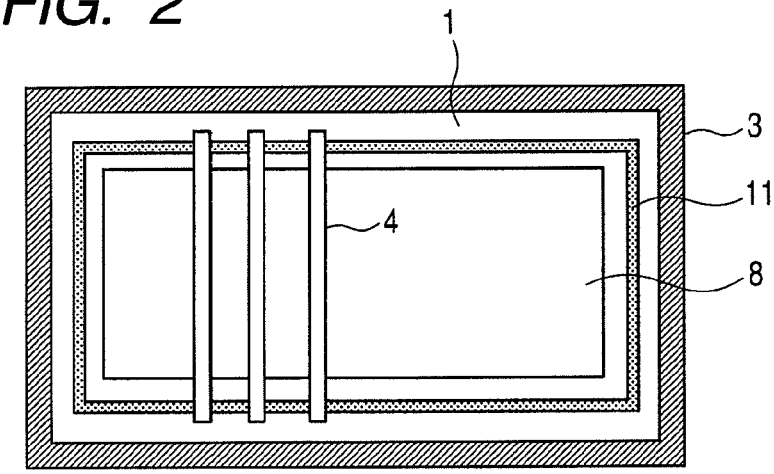
FIG. 2 is a plan view showing a face plate of the display apparatus illustrated in FIG. 1, the plan view being viewed toward the 2-2 direction in FIG. 1.

FIG. 2 is a plan view (looking-up view) illustrating the face plate, which is viewed toward the 2-2 direction in FIG. 1. Referring to FIG. 2, a potential defining electrode 11 which surrounds the anode electrode 8, and is positioned apart from the anode electrode 8. In the example illustrated in FIG. 2, the anode electrode 8 and the potential defining electrode 11 are opposite to each other through a gap, whereby the glass substrate 6 is exposed at the portion between the anode electrode 8 and the potential defining electrode 11. Consequently, a high resistive film (not illustrated) connected to the anode electrode 8 and the potential defining electrode 11 may be provided on the portion between the anode electrode 8 and the potential defining electrode 11 so as to suppress a charge of the glass substrate 6.

Here, it is desirable that the potential of the potential defining electrode 11 is defined to the ground potential. However, the potential of the potential defining electrode 11 is not limited to the ground potential if it is lower than the anode potential. The potential defining electrode 11 limits extension of a high-potential space formed around the anode electrode 8, and a shape of the potential defining electrode 11 is not specifically limited. The potential defining electrode 11 may be provided so as to surround a not-illustrated potential extraction portion provided on the periphery of face plate 1, for example, in order to obtain the high potential from the side of the rear plate 2. The height of the potential defining electrode 11 from the surface of the glass substrate 6 of the face plate 1 is substantially the same as the height of the anode electrode 8 from the surface of the glass substrate 6 of the face plate 1.

A support frame 3 is provided between the face plate 1 and the rear plate 2, and the face plate 1, the rear plate 2 and the support frame 3 together constitute a vacuum container. The inside of the vacuum container (i.e., a pressure reduced space S) is maintained at pressure (vacuum) lower than the atmospheric pressure, and, typically at high vacuum or ultra-high vacuum. Further, the face plate 1 and the support frame 3 are mutually bonded and also the rear plate 2 and the support frame 3 are mutually bonded, respectively by a bonding material such as glass frit, low melting point metal or the like.

Figure 3A:
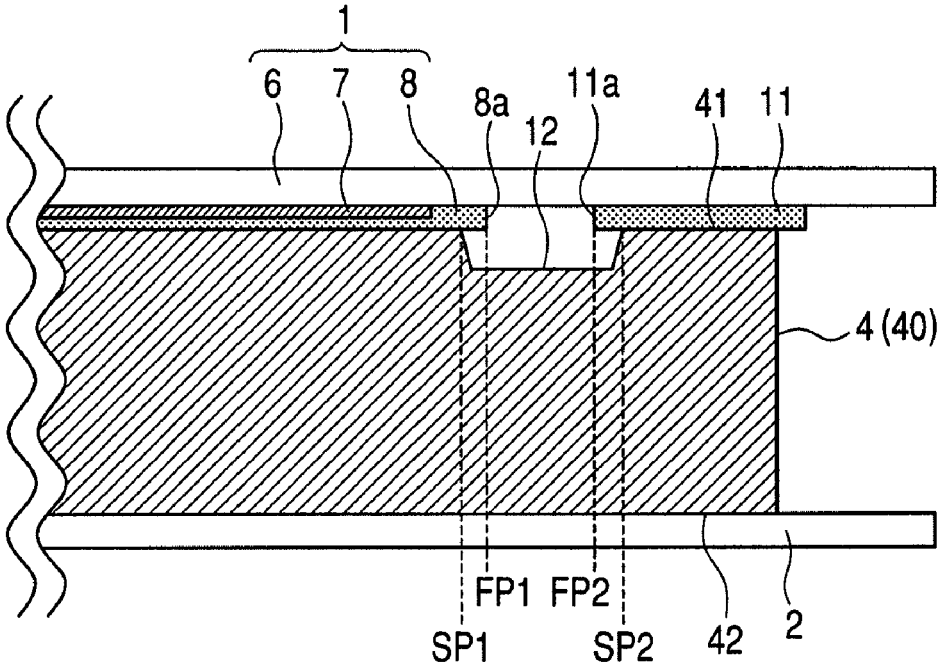
FIG. 3A is a cross sectional view illustrating a shape of a recessed portion of a spacer according to a first embodiment.
Figure 3B:
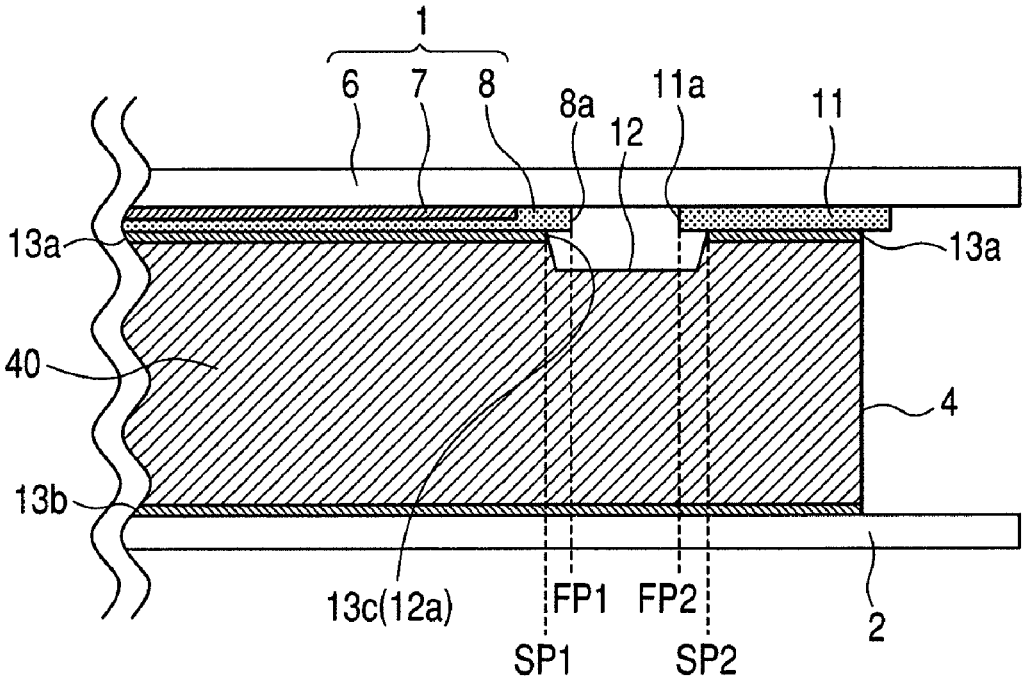
FIG. 3B is a cross sectional view illustrating a shape of a recessed portion of a spacer according to a second embodiment.
Figure 3C:
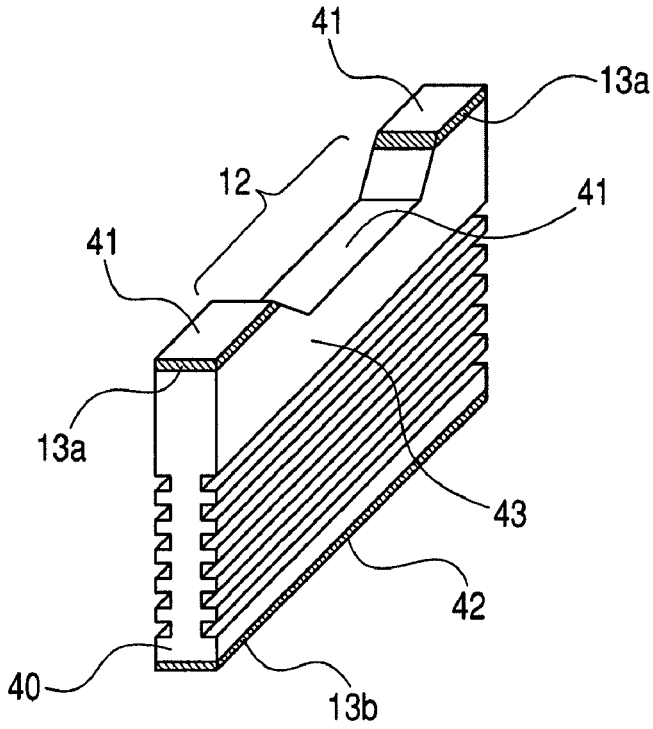
FIG. 3C is a perspective view illustrating the vicinity of the recessed portion of the spacer according to the second embodiment.

Support members, each of which is called a spacer 4, are provided between the face plate 1 and the rear plate 2. Hereinafter, a constitution of the spacer 4 will be described in detail with reference to FIGS. 3A and 3B which are cross sectional views of the display apparatus. More specifically, FIG. 3A is the cross sectional view for describing the display apparatus in a first embodiment, and FIG. 3B is the cross sectional view for describing the display apparatus in a second embodiment. In each of FIGS. 3A and 3B, the display apparatus is viewed from a direction which is in parallel with a spacer longitudinal direction and along a section perpendicular to the display face of the display apparatus. FIG. 3C is a perspective view illustrating a part of the spacer used in the second embodiment of the present invention. Here, the first embodiment and the second embodiment are different from each other in the point of presence/absence of an electrode film.

The spacer 4 comprises at least a plate insulative base member 40. The spacer 4 is typically the plate member in which an antistatic high resistive film (not illustrated) is provided on the surface (side face) of the plate insulative base member 40. Further, as illustrated in FIG. 1, plural antistatic grooves (linear concavities and convexities) are provided on the side face of the spacer 4. The face (an opposite face 41) of the spacer 4 on the side of the face plate 1 is opposite to the anode electrode 8 and the potential defining electrode 11 and also in contact with the anode electrode 8 and the potential defining electrode 11 as illustrated in FIG. 3A. The face (a reverse face 42) of the spacer 4 on the side of the rear plate 2 is fixed to the X-direction wirings Dx1 to Dxm as illustrated in FIG. 1. In the present embodiment, the recessed portion 12 is constituted by the surface of the insulative base member 40. The present inventor and the like vacuumized the inside of the display apparatus (that is, the inside of the container constituted by the face plate 1, the rear plate 2 and the support frame 3), then disassembled the display apparatus, and subsequently observed a degree of the contact of the spacer 4. As a result, crushed impressions remained at the portions on the anode electrode 8 and the potential defining electrode 11 being in contact with the spacer 4, whereby the present inventor and the like could confirm that the spacer 4 was in contact with these electrodes. Incidentally, the spacers 4 are not provided on all the X-direction wirings Dx1 to Dxm. That is, the spacers 4 are provided at a rate of one per the two or more X-direction wirings. Since the spacer 4 uses glass, ceramic or the like as the insulative base member 40, it has sufficient intensity to the atmospheric pressure. Voltages are applied to the opposite face 41 and the reverse face 42 of the spacer 4 by the potentials respectively supplied to the rear plate 2 and the face plate 1, whereby a potential distribution is formed on the surface of the spacer 4.

The spacer 4 has a recessed portion (notch) 12 on its face (opposite face 41) opposite to the face plate 1. More specifically, the insulative base member 40 of the spacer 4 has the recessed portion 12, and the recessed portion 12 is constituted by the surface of the insulative base member 40. The recessed portion 12 constituting a part of the opposite face 41, does not contact with the face plate (the anode electrode 8 and the potential defining electrode 11). That is, the opposite face 41 of the spacer 4 partly contacts with the anode electrode and the potential defining electrode. The recessed portion 12 opens on the both side faces of the spacer 4. The side faces are the faces which continue on the opposite face 41, and the two faces which are exposed in the space (vacuum space) between the face plate 1 and the rear plate 2. The opening shape of the recessed portion 12 viewed from the direction of the side face of the spacer 4 is trapezoidal. However, the opening shape may be polygonal, or substantially semicircle or semielliptic having curvature. It is desirable for the recessed portion 12 to have the depth of 10 μm or more, and it is further desirable to have the depth of 100 μm or more. Incidentally, the depth of the recessed portion 12 is equivalent to a maximum length of the line extending vertically from the face of connecting the both sides (SP1, SP2) of the edges of the recessed portion 12 onto the surface of the recessed portion 12 in the insulative base member 40 of the spacer 4. The recessed portion 12 can be formed in an arbitrary method such as a grinding method or the like using a diamond wheel. As illustrated in FIG. 3A, the recessed portion 12 is opposite to the portion of the face plate 1 between the anode electrode 8 and the potential defining electrode 11 (i.e., the portion where the surface of the glass substrate is exposed) through a gap. Further, the recessed portion 12 is opposite to a portion including an end 8*a* of the anode electrode 8 and also a portion including an end 11*a* of the potential defining electrode 11 through a gap. More specifically, the end 8*a* of the anode electrode 8 on the side of the potential defining electrode 11 is positioned (FP1) nearer to the potential defining electrode 11 than the edge (SP1) of the recessed portion 12 on the side of the anode electrode. Likewise, the end 11*a* of the potential defining electrode 11 on the side of the anode electrode 8 is positioned (FP2) nearer to the anode electrode 8 than the edge (SP2) of the recessed portion 12 on the side of the potential defining electrode 11. That is, the end 8*a* of the anode electrode 8 and the end 11*a* of the potential defining electrode 11, which are opposite to each other, are positioned in the space between the recessed portion 12 and the face plate 1. In other words, the recessed portion 12 is formed so that the end 8*a* of the anode electrode 8 and the end 11*a* of the potential defining electrode 11 are exposed in the space between the recessed portion 12 and the face plate 1. Further, it can be expressed that an orthogonal projection of the portion between the anode electrode 8 and the potential defining electrode 11 to the spacer 4 is wholly held within the edges of the recessed portion 12. More specifically, the length of the recessed portion 12 in the longitudinal direction of the spacer (that is, a distance between SP1 and SP2) may be set to be longer than the interval between the end 8*a* and the end 11*a* (that is, a distance between FP1 and FP2).

The potential at the contact portion of the spacer 4 and the anode electrode 8 is substantially equal to the potential of the anode electrode (i.e., the anode potential), and the potential at the contact portion of the spacer 4 and the potential defining electrode 11 is substantially equal to the potential of the potential defining electrode 11. However, although the anode electrode 8 and the spacer 4 are wholly in contact with each other, it is conceivable that micro-gaps actually exist in the contact portion of the anode electrode 8 and the spacer 4 due to various causes such as manufacturing errors, assembling errors, surface roughness of the contact portion, and the like. Likewise, although the potential defining electrode 11 and the spacer 4 are wholly in contact with each other, it is conceivable that micro-gaps actually exist in the contact portion of the potential defining electrode 11 and the spacer 4. These micro-gaps produce a potential difference between the anode electrode 8 and the spacer 4 and/or a potential difference between the potential defining electrode 11 and the spacer 4, thereby generating the electric discharge. In particular, each of the end 8*a* of the anode electrode 8 and the end 11*a* of the potential defining electrode 11 often has a shape by which electric field concentration occurs easily. More specifically, protrusions such "burr" and the like can be easily formed at these ends. For this reason, the electric discharge is easily generated especially between the ends 8*a* and 11*a* and the spacer 4.

According to the present embodiment, the end 8*a* and the end 11*a* are positioned in the space between the recessed portion 12 and the face plate 1, and gaps each having an interval sufficient for preventing the electric discharge can be easily secured between the ends 8*a* and 11*a* and the spacer 4. A shape and a size of the recessed portion 12 can be arbitrarily set. More specifically, it is possible to properly determine the shape and the size of the recessed portion 12 so as to be able to secure adequate distances between the ends 8*a* and 11*a* and the periphery of the recessed portion 12.

As the second embodiment, as illustrated in FIGS. 3B and 3C, an electrode film can be provided on the opposite face 41 of the spacer 4, that is, in the connecting portion of the anode electrode 8 and the potential defining electrode 11. Also, an electrode film can be provided on the reverse face 42 of the spacer 4, that is, in the connecting portion to the X-direction wirings Dx1 to Dxm. The spacer 4 comprises the insulative base member 40 and the electrode film. Here, the electrode film can include an opposite-face electrode film 13*a* provided on the side of the face plate 1 and a reverse-face electrode film 13*b* provided on the side of the rear plate 2. It is possible, by the electrode film, to surely define the potential on the surface of the spacer 4 (e.g., potential of a high resistive film). Further, FIG. 3C illustrates grooves which are provided on a side face 43 of the spacer 4. Also, in the present embodiment, a not-illustrated high resistive film can be provided on the side face 43 of the spacer 4.

The electrode film 13*a*, which is provided on the insulative base member 40, constitutes a part of the opposite face 41 of the spacer 4. Also, in the present embodiment, the recessed portion 12 is constituted by the surface of the insulative base member 40. That is, in the present embodiment, the opposite face 41 is constituted by the opposite-face electrode film 13*a* and the recessed portion 12 of the insulative base member 40. The recessed portion 12 constituting a part of the opposite face 41, does not contact with the face plate (the anode electrode 8 and the potential defining electrode 11). That is, the opposite face 41 of the spacer 4 partly contacts with the anode electrode and the potential defining electrode via the opposite-face electrode film 13*a*. The opposite-face electrode film 13*a* is arranged so as to include a first portion on the side of the anode electrode 8 and a second portion on the side of the potential defining electrode 11, while interposing the recessed portion 12 between the first and second portions. Incidentally, the first portion and the second portion may be constituted respectively by different materials. However, if these portions are constituted by the same material, it is possible to simplify manufacturing of the spacer 4. The spacer 4 is electrically conducted to the anode electrode 8 through the first portion of the electrode film 13*a*, while the spacer 4 is electrically conducted to the potential defining electrode 11 through the second portion of the electrode film 13*a*. For this reason, it is effective to set the spacer 4 and the anode electrode 8 to have the same potential, and it is also effective to set the spacer 4 and the potential defining electrode 11 to have the same potential. Of course, a potential distribution according to the potential difference between the potential of the anode electrode 8 and the potential of the potential defining electrode 11 is generated on the surface of the spacer 4. The connection between the opposite-face electrode film 13*a* of the spacer 4 and the anode electrode 8 and the potential defining electrode 11 includes not only a case where these parts are mutually in contact and thus electrically connected but also a case where these parts are electrically connected through substantially low resistive members existing between them. Even in case of using the electrode film 13*a* like this, if the end 8*a* of the anode electrode 8 and the end 11*a* of the potential defining electrode 11 are positioned in the space between the recessed portion 12 of the spacer 4 and the face plate 1, it is possible to bring about the same effect as that in the first embodiment. Incidentally, it is desirable that an end 13*c* of the electrode film 13*a* coincides with an edge 12*a* of the recessed portion 12 of the recessed portion of the spacer 4 on the side of the anode electrode. More specifically, it is desirable that the end 13*c* of the electrode film 13*a* continues on the edge 12*a*, on the side of the anode electrode, of the recessed portion 12 constituted by the insulative base member 40.

When the thickness of the electrode film 13*a* becomes extremely thick, there is a possibility that it affects electron orbits in the vicinity of the face plate 1. Thus, it is desirable to make the thickness of the electrode film thinner, and it is more desirable to set the thickness to be 1 μm or less. For this reason, the distance between the recessed portion 12 and the face plate 1 is substantially subject to the depth of the recessed portion 12. It is desirable to make the depth of the recessed portion 12 ten times or more as much as the thickness of the electrode film, and it is further desirable to make the depth 100 times or more as much as the thickness. As well as the first embodiment, it is desirable for the recessed portion 12 to have the depth of 10 μm or more, and it is further desirable to have the depth of 100 μm or more.

Figure 3D:
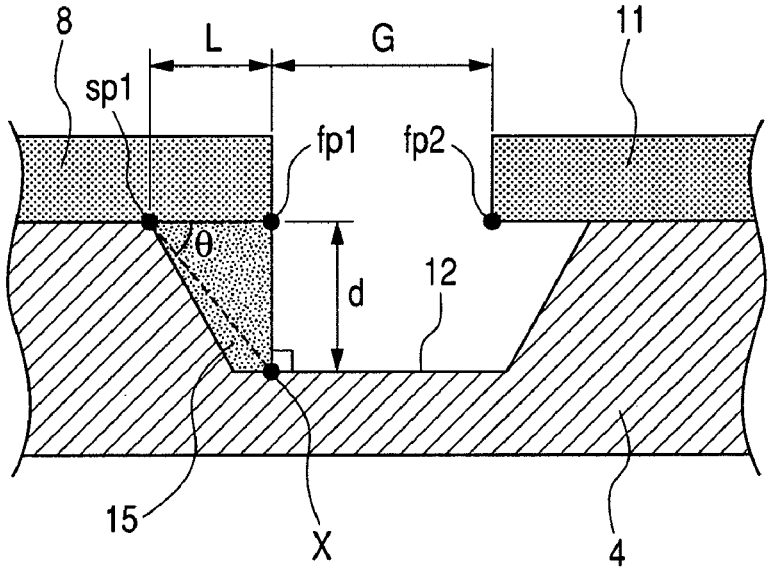
FIG. 3D is a cross sectional view illustrating a shape of a recessed portion of a spacer according to a third embodiment.

In the third embodiment, the length of the anode electrode 8 protruding and extending in the space between the recessed portion 12 and the face plate 1, in the above-described embodiments, is maximized. FIG. 3D is the partial enlarged view obtained from FIG. 3A. Here, it is assumed that an edge of the recessed portion 12 on the side of the anode electrode 8 is sp1, an end of the anode electrode 8 on the side of the spacer is fp1, an end of the potential defining electrode 11 on the side of the spacer is fp2, and a point where the line drawn from the end fp1 to the direction perpendicular to the rear plate 2 crosses the surface of the recessed portion 12 is X. Incidentally, the ends of the anode electrode 8 and the potential defining electrode 11 constitute a portion that the distance between the anode electrode 8 and the potential defining electrode 11 is shortest within the region that the spacer 4 and the face plate 1 are opposite to each other. As illustrated in FIG. 3D, when the portion that the distance is shortest has a certain extent, the ends fp1 and fp2 are the points (in the various ends) closest to the spacer 4. Further, it is assumed that a distance between the edge sp1 and the end fp1 is L, a distance between the ends fp1 and fp2 is G, and a distance between the end fp1 and the point X is d. Since a space 15 demarcated by the edge sp1, the end fp1 and the recessed portion is a strong electric field region, the strong electric field region enlarges if the distance L becomes extremely large. As a result, the frequency of occurrence of micro-discharges increases. Further, if the distance d is extremely smaller than the distance (length) L, the electric field of the space 15 increases, whereby the frequency of occurrence of micro-discharges increases. Consequently, an appropriate upper limit value is set to the distance L, and an appropriate lower limit is set to d/L.

The present embodiment satisfies $0<L\leqq 0.1\times G$, and $\arctan(d/L)\geqq 12°$. It is further desirable to satisfy $0<L\leqq 0.05\times G$, and arctan(d/L) 12°. If the distance L is equal to or less than $0.1\times G$, it is possible to limit the range of the above-described strong electric field region. Further, arctan(d/L) is equal to an angle θ in FIG. 3D. If the angle θ becomes small, the anode electrode 8 and the surface of the recessed portion 12 come close to each other, whereby the electric field increases easily. If the angle θ is 12° or more, it is possible to secure an isolation distance between the anode electrode 8 and the surface of the recessed portion 12, whereby it is possible to suppress strength of the electric field. Thus, it is possible to avoid occurrence of discharges by such effects as described above. Incidentally, the angle θ is less than 90°.

The micro-discharge includes, for example, a local and short-time discharge which has an extent that the anode electrode and the peripheral low potential part (a grounded part or the like) are not completely short-circuited by a discharge current. That is to say in relation to an external voltage source, the micro-discharge includes a discharge which has an extent that accumulated discharges do not occur and persistent voltage applying can be performed between the anode and the peripheral low potential part. Incidentally, there is a case where the micro-discharge is a precursory phenomenon of the discharge which causes a short circuit between the anode and the peripheral grounded part. This phenomenon does not damage a driving operation of an apparatus, but should be considered from the aspect of suppression of the discharges.

Although scale is limited, it is possible to detect occurrence of the micro-discharge by detecting a current value and a light emission phenomenon between the anode and the low potential part.

Hereinafter, the present invention will be further described in detail by citing proper examples. That is, in each of the examples described below, a multi-electron beam source in which n×m (n=480, m=100) surface conduction electron-emitting devices having an electron emitting portion on a conductive thin film between device electrodes were matrix-wired by m row-direction wirings and n column-direction wirings was used.

Example 1

The display apparatus in the example has the same constitution as that of the display apparatus described with reference to FIG. 1, and contains RGB phosphors and a black matrix mask for the purpose of color displaying. The distance between the anode electrode 8 and the potential defining electrode 11 was set to 4 mm. Further, the anode electrode 8 was set to also act as the metal back, and the potential of the potential defining electrode 11 was set to the ground potential.

As the spacer 4, the plate base member 40 available as PD200 from ASAHI GLASS CO., LTD. having the height of 2 mm and the width of 0.2 mm was prepared, and the recessed portion 12 was formed on the plate base member by cutting. Here, the shape of the recessed portion 12 was made a trapezoid having the length of 8 mm and the height of 0.3 mm. Then, the spacer 4 was arranged so as to extend from the area of the anode electrode 8 to the area of the potential defining electrode 11 on the face plate 1, and was set to be in contact with both the anode electrode 8 and the potential defining electrode 11. The spacer 4 itself was fixed at a predetermined position on the rear plate 2 by means of a spacer fixing member (not illustrated).

In order to make a study on physical relationship of the edge of the anode electrode 8, the edge of the potential defining electrode 11 and the recessed portion 12 of the spacer 4, following samples were formed. That is, in FIG. 3A, the coordinate axis being in parallel with the spacer longitudinal direction and having the positive direction from the anode electrode 8 toward the potential defining electrode 11 was set. Further, on the above coordinate axis, the coordinate of the position of the edge of the recessed portion 12 on the side of the anode electrode 8 was set to SP1, the coordinate of the position of the edge of the recessed portion 12 on the side of the potential defining electrode 11 was set to SP2, the coordinate of the position of the edge of the anode electrode 8, was set to FP1, and the coordinate of the position of the edge of the potential defining electrode 11 was set to FP2. Further, L1 was defined as L1=FP1−SP1, and L2 was defined as L2=SP2−FP2. Then, the samples in which the size and the position of the recessed portion 12 had been adjusted to respectively set L1 and L2 to −3 mm, −2 mm, −1 mm, −0.2 mm, 0 mm, 1 mm and 2 mm were formed. Here, the state that L1 and L2 have negative values implies the state that the ends of the anode electrode 8 and the potential defining electrode 11 exist outside the recessed portion 12, that is, the state that these ends are in contact with the spacer 4, or the state that these ends are extremely close to the spacer 4. On the other hand, the state that L1 and L2 have positive values implies the state that the ends of the anode electrode 8 and the potential defining electrode 11 exist in the space between the recessed portion 12 and the face plate 1, that is, the state that these ends exist respectively apart from the spacer 4.

Figure 4A:
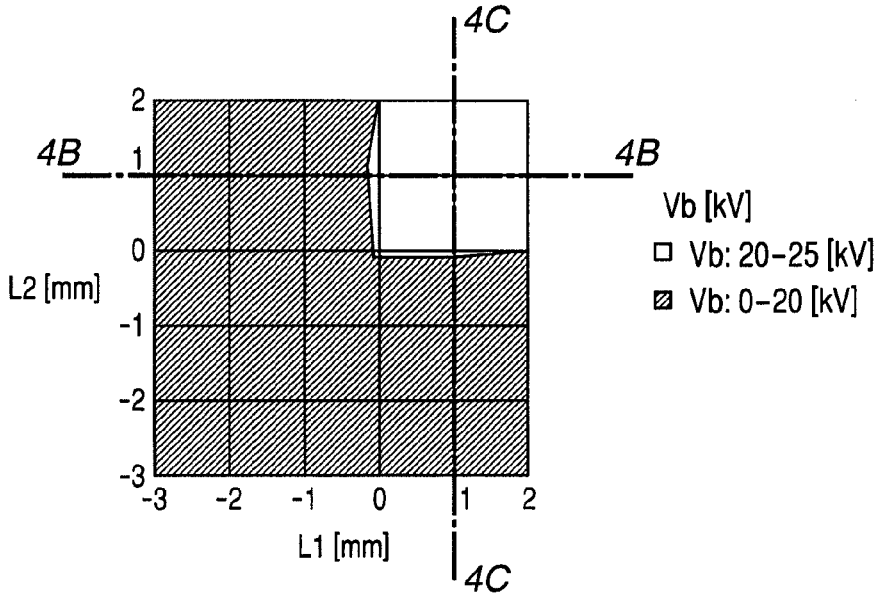
FIGS. 4A, 4B and 4C are diagrams illustrating an effect of the present invention.
Figure 4B:
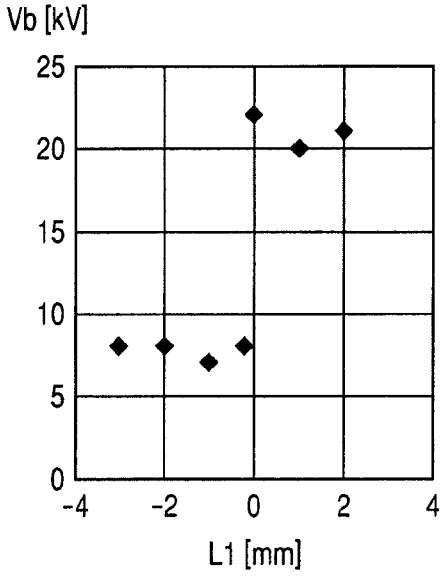
Figure 4C:
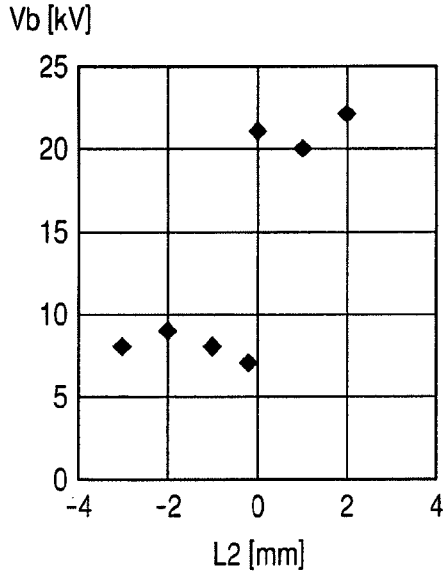

In the display apparatus having the constitution like this, acceleration potential Va was applied to the anode electrode 8 in the state of not driving the electron beam source, and the applied acceleration potential Va was gradually increased. Then, a voltage Vb at the time when the display apparatus started the electric discharge was obtained. FIG. 4A is a graph illustrating the relation of Vb, L1 and L2, FIG. 4B is a graph illustrating the relation of Vb and L1 in a case where L2 was fixed to 1 mm (the state along the 4B-4B line illustrated in FIG. 4A), and FIG. 4C is a graph illustrating the relation of Vb and L2 in a case where L1 was fixed to 1 mm (the state along the 4C-4C line illustrated in FIG. 4A). It can be understood from these graphs that withstand voltage for the electric discharge increases when L1≧0 and L2≧0, that is, when the mutually opposite ends 8*a* and 11*a* of the anode electrode 8 and the potential defining electrode 11 are positioned in the space between the recessed portion 12 of the spacer 4 and the face plate 4. Then, when the display apparatus satisfying such a condition was driven at the acceleration potential Va=10 kV, any electric discharge was not observed, and it was confirmed that image quality obtained by the display apparatus was satisfactory.

Example 2

The constitution in the example 2 is the same as that in the example 1 except that the spacer is equipped with the electrode films 13*a* and 13*b*. The electrode film 13*a* is a tungsten electrode which is in contact with the anode electrode 8 and the potential defining electrode 11 and thus electrically connected to them. Likewise, the electrode film 13*b* is a tungsten electrode which is in contact with the electrodes (i.e., the X-direction wirings Dx1 to Dxm) within the image area of the rear plate 2 and thus electrically connected to them. Here, the respective tungsten electrodes were formed by sputtering.

As well as the example 1, also in this example, the coordinate axis was set, and SP1, SP2, FP1, FP2, L1 and L2 were defined respectively. Further, the samples in which the size and the position of the recessed portion 12 had been adjusted to respectively set L1 and L2 to −3 mm, −2 mm, −1 mm, −0.2 mm, 0 mm, 1 mm and 2 mm were formed. The electrode film 13*a* of the spacer 4 extends up to the upper both ends of the recessed portion 12 and terminates thereat in either case.

In the display apparatus having the constitution like this, acceleration potential Va was applied to the anode electrode 8 in the state of not driving the electron beam source, and the applied acceleration potential Va was gradually increased. Then, a voltage Vb at the time when the display apparatus started the electric discharge was obtained. As a result, the same effect as that illustrated in FIGS. 4A to 4C was obtained. More specifically, it was understood that the withstand voltage for the electric discharge increased when L1≧0 and L2≧0, that is, when the mutually opposite ends 8*a* and 11*a* of the anode electrode 8 and the potential defining electrode 11 were positioned in the space between the recessed portion 12 of the spacer 4 and the face plate 1. Then, when the display apparatus satisfying the relevant condition was driven at the acceleration potential Va=10 kV, any electric discharge was not observed, and it was confirmed that image quality obtained by the display apparatus was satisfactory.

Example 3

In the example 3, the values of L1 and L2 described in the example 1 were set to 200 μm and 1200 μm respectively, and the size of the recessed portion and the physical relationship of the anode electrode and the potential defining electrode ware changed so as to give the length d of the perpendicular line from fp1 described in the third embodiment as 85 μm. That is, the others are the same as those in the example 1, and thus the display apparatus having the spacer was formed. The acceleration potential Va=25 kV was applied to the anode electrode, and the ground potential was applied to the potential defining electrode. As a result, any electric discharge was not observed, the micro-discharge being the precursory phenomenon of the discharge was not observed, and it was confirmed to be able to apply the high voltage stably.

While the present invention has been described with reference to the exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-195421, filed Aug. 26, 2009, and Japanese Patent Application No. 2010-159637, filed Jul. 14, 2010, which are hereby incorporated by reference herein in their entireties.

What is claimed is:

1. A display apparatus comprising:

a rear plate which has an electron-emitting device;

a face plate which is opposite to the rear plate, and has an anode electrode defined with a potential higher than a potential of the electron-emitting device, and a potential defining electrode positioned apart from the anode electrode and defined with a potential lower than the potential of the anode electrode; and a plate spacer comprising at least an insulative base member and being arranged between the rear plate and the face plate and having a face opposing to the face plate, the face partly contacting with the anode electrode and the potential defining electrode, wherein the insulative base member has a recessed portion in the face, and the recessed portion opposes through a gap to a portion of the face plate between the anode electrode and the potential defining electrode, an end of the anode electrode on a side of the potential defining electrode is positioned closer to the potential defining electrode than an edge of the recessed portion on a side of the anode electrode, and an end of the potential defining electrode on a side of the anode electrode is positioned closer to the anode electrode than an edge of the recessed portion on a side of the potential defining electrode.

2. A display apparatus according to claim 1, wherein the spacer further comprises an electrode film disposed on the insulative base member, the electrode film constituting a part of the face and contacting with the anode electrode, and an end of the electrode film links to an edge of the recessed portion on a side of the anode electrode.

3. A display apparatus according to claim 1, wherein the edge of the recessed portion on the side of the anode electrode is sp1, the end of the anode electrode on the side of the potential defining electrode is fp1, the end of the potential defining electrode on the side of the anode electrode is fp2, the point where the line drawn from the end fp1 to the direction perpendicular to the rear plate crosses the surface of the recessed portion is X, a distance between the edge sp1 and the end fp1 is L, a distance between the end fp1 and the end fp2 is G, and a distance between the end fp1 and the point X is d, and they satisfy $0<L\leqq 0.1\times G$, and $12°\leqq \arctan(d/L)<90°$.

4. A display apparatus according to claim 3, wherein the distance L satisfies $0<L\leqq 0.05\times G$.

5. A display apparatus according to claim 2, wherein a depth of the recessed portion is ten times or more as much as a thickness of the electrode film.

6. A display apparatus according to claim 2, wherein a depth of the recessed portion is 100 times or more as much as a thickness of the electrode film.

7. A display apparatus according to claim 5, wherein the thickness of the electrode film is 1 μm or less.

8. A display apparatus according to claim 1, wherein the depth of the recessed portion is 10 μm or more.

9. A display apparatus according to claim 2, wherein the edge of the recessed portion on the side of the anode electrode is sp1, the end of the anode electrode on the side of the potential defining electrode is fp1, the end of the potential defining electrode on the side of the anode electrode is fp2, the point where the line drawn from the end fp1 to the direction perpendicular to the rear plate crosses the surface of the recessed portion is X, a distance between the edge sp1 and the end fp1 is L, a distance between the end fp1 and the end fp2 is G, and a distance between the end fp1 and the point X is d, and they satisfy $0<L\leqq 0.1\times G$, and $12°\leqq \arctan(d/L)<90°$.

10. A display apparatus according to claim 3, wherein the distance L satisfies $0<L\leqq 0.05\times G$.

11. A display apparatus according claim 2, wherein the depth of the recessed portion is 10 μm or more.

* * * * *